United States Patent [19]

Büchler et al.

[11] Patent Number: 4,478,773

[45] Date of Patent: Oct. 23, 1984

[54] SCAFFOLDING GIRDER FOR CONSTRUCTING MULTIPLE-SPAN BRIDGE STRUCTURES MOVABLE FROM ONE BRIDGE TO ANOTHER

[75] Inventors: Wilhelm Büchler, Haar; Karl-Hermann Mischlau, Munich, both of Fed. Rep. of Germany

[73] Assignee: Dyckerhoff & Widmann Aktiengesellschaft, Munich, Fed. Rep. of Germany

[21] Appl. No.: 176,576

[22] Filed: Aug. 8, 1980

[30] Foreign Application Priority Data

Aug. 16, 1979 [DE] Fed. Rep. of Germany ..... 2933061

[51] Int. Cl.[3] ..... E04B 1/16

[52] U.S. Cl. ..... 264/31; 264/33; 264/35

[58] Field of Search ..... 264/31, 33, 35

[56] References Cited

U.S. PATENT DOCUMENTS 3,003,219 10/1961 Suter ..... 264/33

3,961,457 6/1976 Zalewski ..... 264/35

4,228,114 10/1980 Alsen ..... 264/33

*Primary Examiner*—John A. Parrish

*Attorney, Agent, or Firm*—Toren, McGeady and Stanger

[57] ABSTRACT

In a multiple-span bridge structure with side-by-side bridges, a scaffolding girder-formwork assembly is movable in the longitudinal direction of each bridge for constructing individual sections of the superstructure over support piers. After use on one bridge, the scaffolding girder-formwork assembly is movable to the other bridge by first rotating it about a vertical axis from the longitudinal direction of the bridge to the transverse direction while the assembly is centered over a pier of the one bridge. A support for the assembly is moved over a pier on the other bridge. Then the assembly is moved in the transverse direction until it is centered over the pier of the other bridge. Subsequently, the assembly is rotated into the longitudinal direction of the other bridge in position for constructing sections of the superstructure.

4 Claims, 9 Drawing Figures

SCAFFOLDING GIRDER FOR CONSTRUCTING MULTIPLE-SPAN BRIDGE STRUCTURES MOVABLE FROM ONE BRIDGE TO ANOTHER

SUMMARY OF THE INVENTION

The present invention is directed to a method of and apparatus for transferring a scaffolding girder used for constructing the superstructure of a multiple-span bridge structure from one to another of a pair of side-by-side bridges. The scaffolding girder dependently supports the formwork and is located above the superstructure. The scaffolding girder is supported via trestles on the superstructure so that it can be moved relative to the superstructure.

There are known methods of constructing a multiple-span bridge structure of prestressed concrete with the aid of formwork suspended from a scaffolding girder. The scaffolding girder is movable above the superstructure and is supported on the opposite ends of the span to be concreted on adjacent piers of the bridge. In such a method, a scaffolding girder, constructed as a torsionally rigid box girder of metal, is used and includes spaced girders extending transversely in a cantilevered manner from both sides of the scaffolding girder. These transverse girders are formed in such a manner that they surround the bridge structure to be erected in the region of the bridge piers, note West German Pat. No. 12 43 711. In this scaffolding girder, the formwork is arranged rigidly and a long section of superstructure up to about one span length can be constructed using this formwork. In addition, there are arrangements in which concreting platforms are movably suspended from a scaffolding girder with such platforms merely serving for the construction of a cantilever section with the cantilevered part being formed section by section, note West German Pat. No. 22 05 250.

The width of a bridge which can be constructed using such scaffolding girders is limited not only by the weight but also by the design considerations of the scaffolding girders. Therefore, and particularly for highways with directional traffic lanes, such as, expressway bridges, two separate bridge structures in side-by-side relationship are being used increasingly where successive sections of the twin bridges are formed by means of the same scaffolding girder. In such a procedure, after one bridge is completed, the scaffolding girder must be dismantled and then reassembled for use on the other bridge.

Therefore, it is the primary object of the present invention to reduce the costs involved in such bridge building procedures by transferring the scaffolding girder from one bridge to the other without dismantling.

In accordance with the present invention, the scaffolding girder centered over a pier of one bridge is rotated from the longitudinal direction of the bridge to a transverse position while supported by at least one trestle. Subsequently one of the trestles is moved over the pier of the other bridge and the scaffolding girder is moved in the transverse direction until it is centered over the pier of the other bridge. Subsequently, the scaffolding girder is rotated back into the longitudinal direction of the other bridge so that it is in a new working position.

Additional advantages of the invention will be apparent from the subsequent description.

One of the advantages of the present invention is the avoidance of the costs involved in the time-consuming and expensive transfer of the scaffolding girder which has been a problem in the past. Previously, it was necessary to dismantle the scaffolding girder on one bridge, transport it to another bridge, and then reassemble the scaffolding girder on the second bridge. In accordance with the present invention, the scaffolding girder is rotated at approximately its working height, it is moved to the adjacent other bridge by known advancing or carrying devices and once on the other bridge, it is rotated into the new working direction. The transfer of the scaffolding girder from one bridge to the other is possible in all cases in which the distance between the bridges does not exceed the normal length of a span in one of the bridges. The transfer operation is not bound to any certain static system of the bridge nor to any particular cross-sectional shape of the superstructure.

During rotation, the scaffolding girder can remain at its normal working height. Since the formwork suspended from the scaffolding girder surrounds the section of the superstructure to be constructed, the last section of the superstructure may not be built in this case, since the scaffolding girder could not be rotated. This final portion of the superstructure would have to be concreted subsequently using a separate formwork.

In accordance with the present invention, however, it is possible in a simple manner to rotate the scaffolding girder even if the last section of the superstructure has been built. It is merely necessary to lift the scaffolding girder prior to rotation until the lower surface of the formwork is located above the superstructure and to move it in this raised position to the adjacent bridge where, after rotating the scaffolding girder and the formwork, the assembly can be lowered into the new working position.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
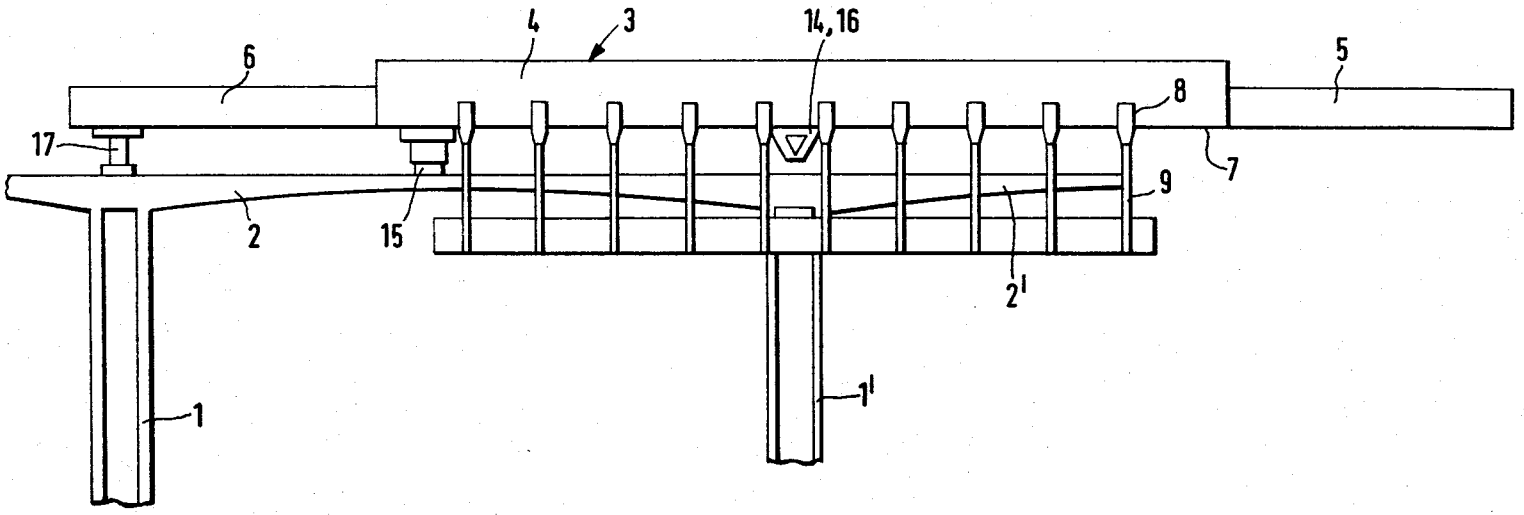
FIG. 1 is a side view of a longitudinally extending portion of a bridge structure with the scaffolding girder in the last position.
Figure 4:
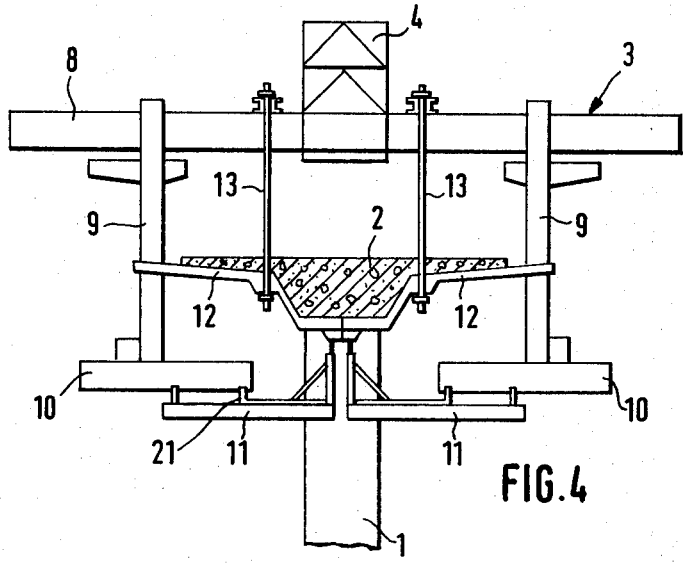
FIG. 4 is a cross-sectional view through the scaffolding girder in position for concreting a longitudinally extending section of the superstructure.
Figure 5:
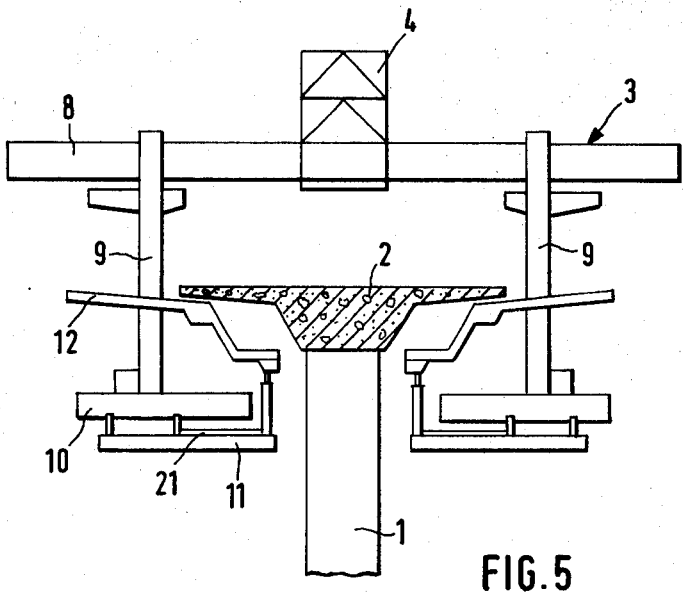
FIG. 5 is a view similar to FIG. 4, however, showing the scaffolding girder in position to be moved.

In the drawing a multiple-span bridge structure with side-by-side bridges is illustrated. In FIG. 1 one of the bridges is shown schematically and consists of vertically extending reinforced concrete columns or piers 1 with superstructure sections 2 cantilevering in the longitudinal direction of the bridge from both sides of the pier. The superstructure sections are flexurally rigidly connected. In cross-section, note FIGS. 4 through 6, the superstructure 2 has the shape of a hollow box with obliquely upwardly extending girder webs with a roadway slab cantilevered outwardly from both sides of the box. This construction of the superstructure 2 is shown merely by way of example and the invention is not limited by the design of the bridge.

Figure 2:
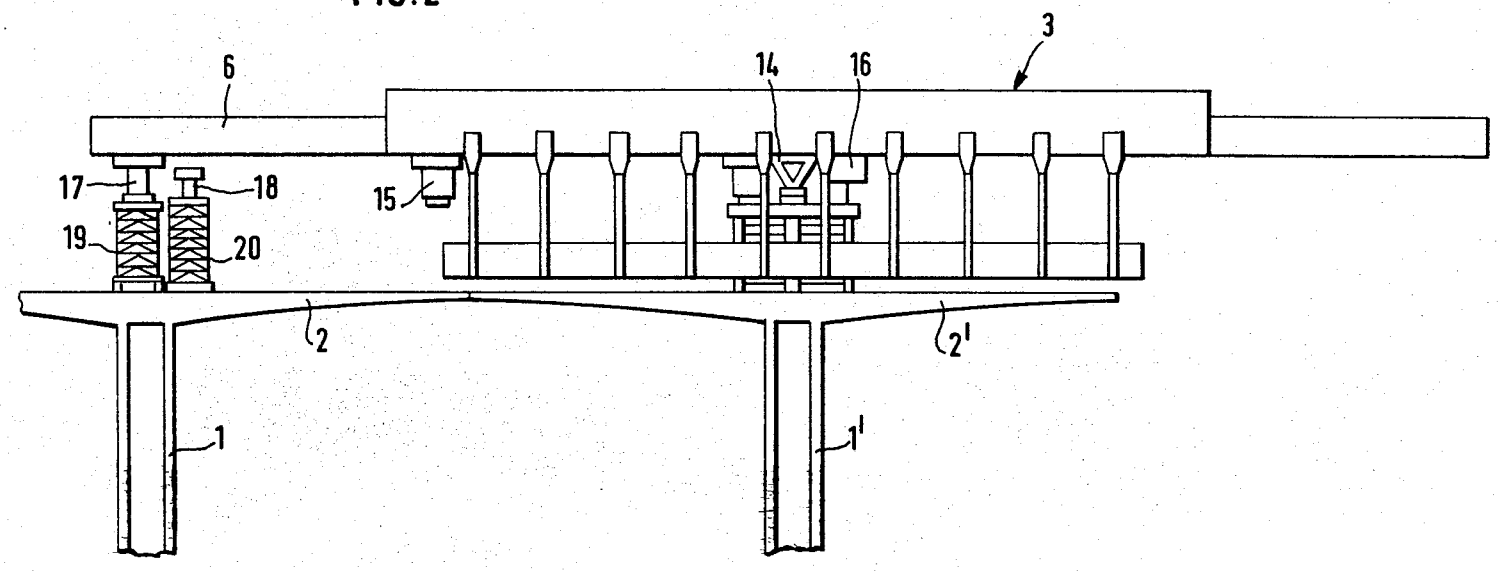
FIG. 2 is a side view similar to FIG. 1 with the scaffolding girder in the raised position.
Figure 3:
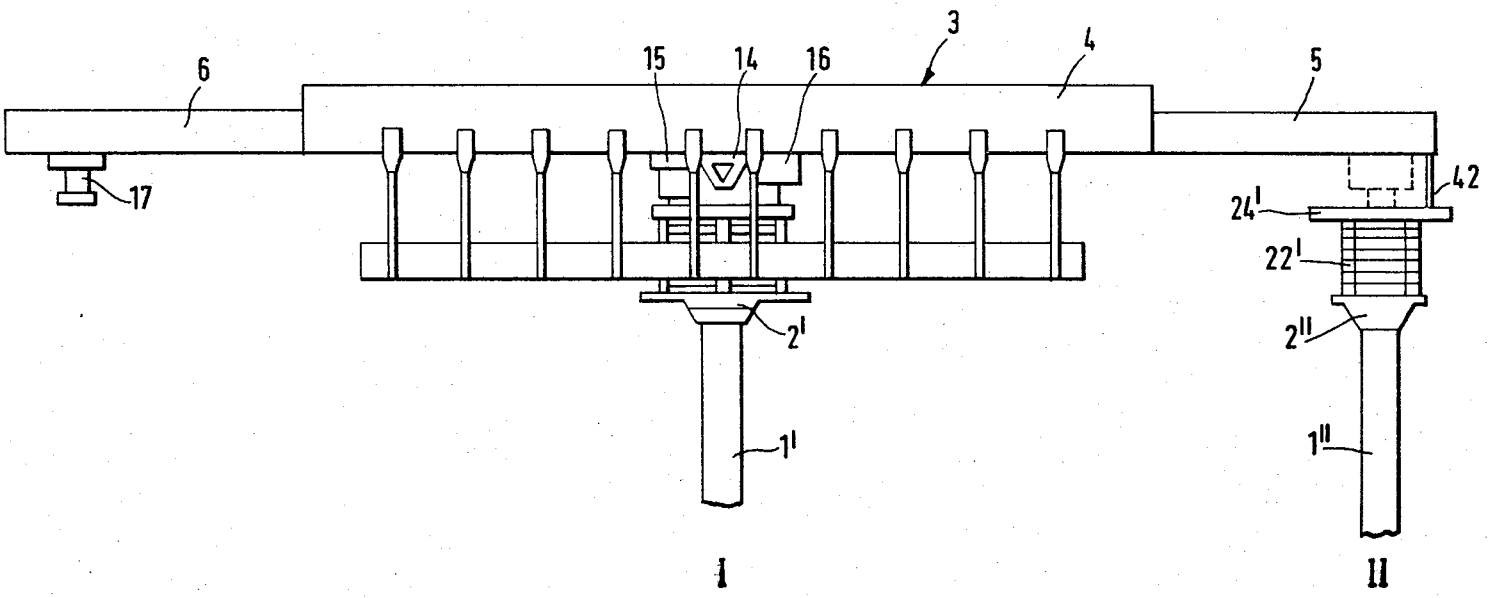
FIG. 3 is a side view transversely of the direction shown in FIGS. 1 and 2 of a pair of bridges in side-by-side relation with the scaffolding girder rotated by 90° from the position shown in the previous figures.

As can be seen in FIGS. 1, 2 and 3, the scaffolding girder 3 is made up of a middle box section 4 with two end girder sections 5, 6 of smaller cross-section to afford a reduction in weight. It should be noted that the lower surface 7 of the box section 4 is flush with the lower surfaces of the end sections 5, 6. Girders 8 extend transversely of and cantilever outwardly from the middle box section 4 of the scaffolding girder. The transverse girders 8 extend laterally from the lower portion of the middle box section 4. Girders 9 vertically depend from the transverse girders 8 and are arranged for movement in the horizontal direction on the girders. At the lower ends of the girders 9 horizontally arranged outer platform girders 10 form a work platform. The space between the inner ends of the outer platform girders 10 is closed by inner platform girders 11 which are horizontally arranged and are horizontally movably supported on the outer platform girders. Because of this feature of horizontal movability, an opening can be formed between a pair of the inner platform girders, note FIG. 5.

Formwork 12 for the superstructure is suspended from the transverse girders 8 by means of rods 13. The formwork 12 can be lowered onto the lower work platforms 21 for movement past the columns 1.

Figure 6:
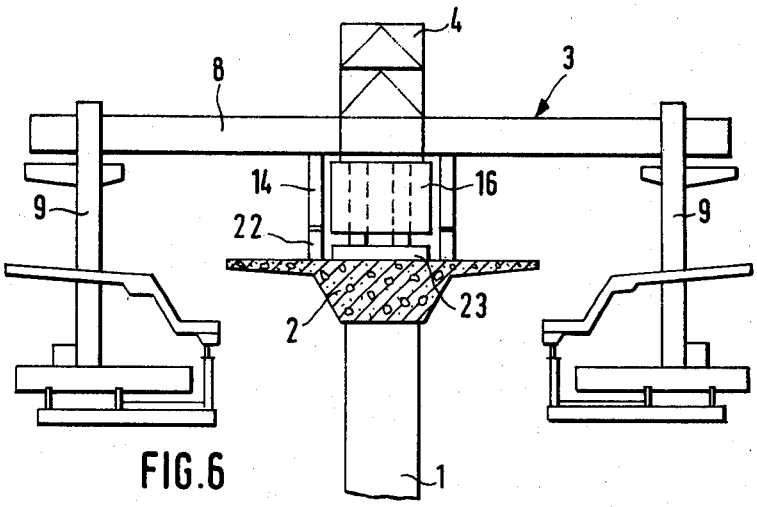
FIG. 6 is a cross-sectional view of the scaffolding girder arrangement as shown in FIGS. 4 and 5 during lifting.
Figure 7:
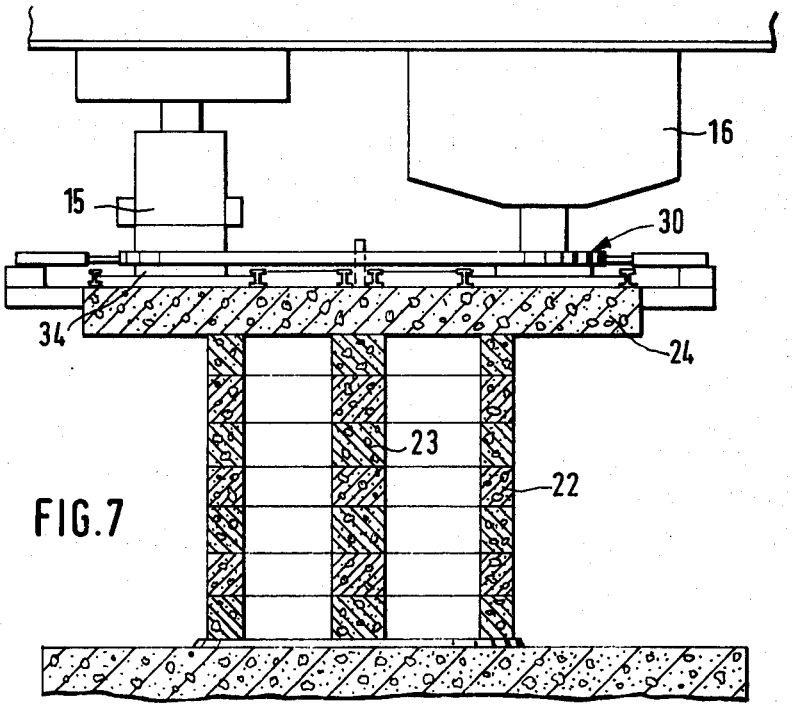
FIG. 7 is an enlarged view of the structure employed in rotating the scaffolding girder.

In the construction stage displayed in FIG. 1, superstructure span 2' has been formed by means of the scaffolding girder 3. To rotate the scaffolding girder from the longitudinal direction of the span, initially it must be lifted above the upper surface of the superstructure, note FIG., 2 where the scaffolding girder 3 and the parts assembled on it are located above the upper surface of the superstructure 2. In preparation for raising the scaffolding girder, the inner platform girders 11 are retracted and the formwork 12 is lowered onto the work platforms 21, note FIG. 5. Subsequently, the dependently supported girders 9 are moved outwardly along the transverse girders 8 as is shown in FIG. 6. With the scaffolding girder 3 and its assembled supporting parts located laterally outwardly from the superstructure 2, the scaffolding girder can be lifted upwardly.

The scaffolding girder is supported on the superstructure 2 by means of a frame 14 and three roller blocks or trestles 15, 16 and 17. Roller trestles 15, 16 and 17 can be moved while suspended from the lower surface 7 of the scaffolding girder 3 or the scaffolding girder can be moved over the roller trestles if the trestles are supported on the superstructure.

To raise the scaffolding girder 3 step by step, two supports are always required. These supports are formed above the column 1' by the frame 14 and the roller trestle 16 located therebetween on the same axis. Toward the end of the scaffolding girder 3 formed by the end girder section 6, an auxiliary trestle 18 is mounted next to the roller trestle 17. By alternately raising the scaffolding girder 3 by means of lifting devices mounted on the roller trestles 17, 18 and the roller trestle 16 respectively, and by placing appropriate support structure below the scaffolding girder, the position illustrated in FIG. 2 is reached in which the lower surface of the formwork 12 is located above the upper surface of the superstructure 2.

Conventional structures, for example, support towers 19 or 20 can be used as supports for the roller trestle 17 and the auxiliary trestle 18. A special explanation, however, is required for the normal main support of the scaffolding girder 3 on the frame or portal 14 where the rotating arrangement is to be mounted. At this location, as the scaffolding girder 3 is being raised by means of the frame 14 and the trestle 16, prefabricated concrete parts are assembled resulting in an annular tower with other prefabricated parts forming a central pier within the tower on which trestle 16 is supported. As soon as the required height is reached, a slab 24 made up of prefabricated concrete parts is placed on the tower 22, the slab is prestressed in the longitudinal and transverse directions. The slab 24 rests not only on the annular wall of the tower 22 but also on the inner or central pier 23.

Figure 8:
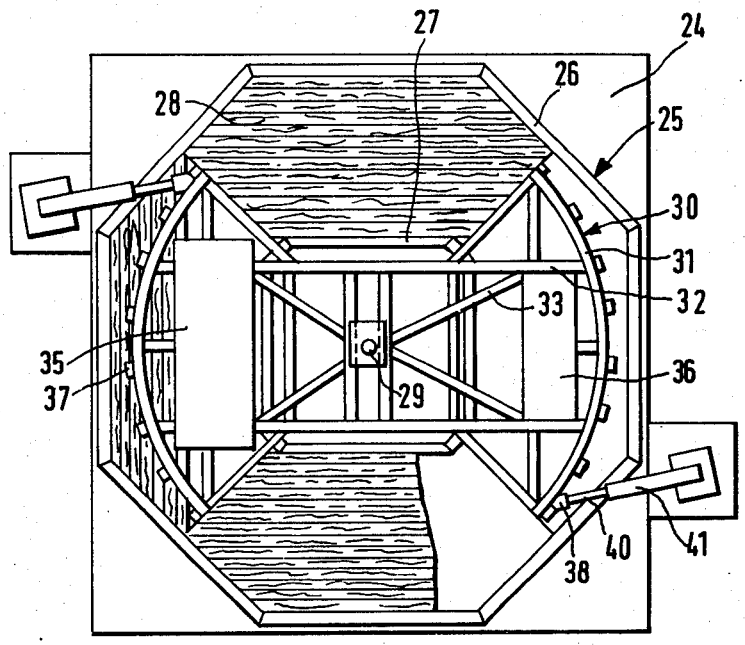
FIG. 8 is a plan view of the arrangement shown in FIG. 7.
Figure 9:
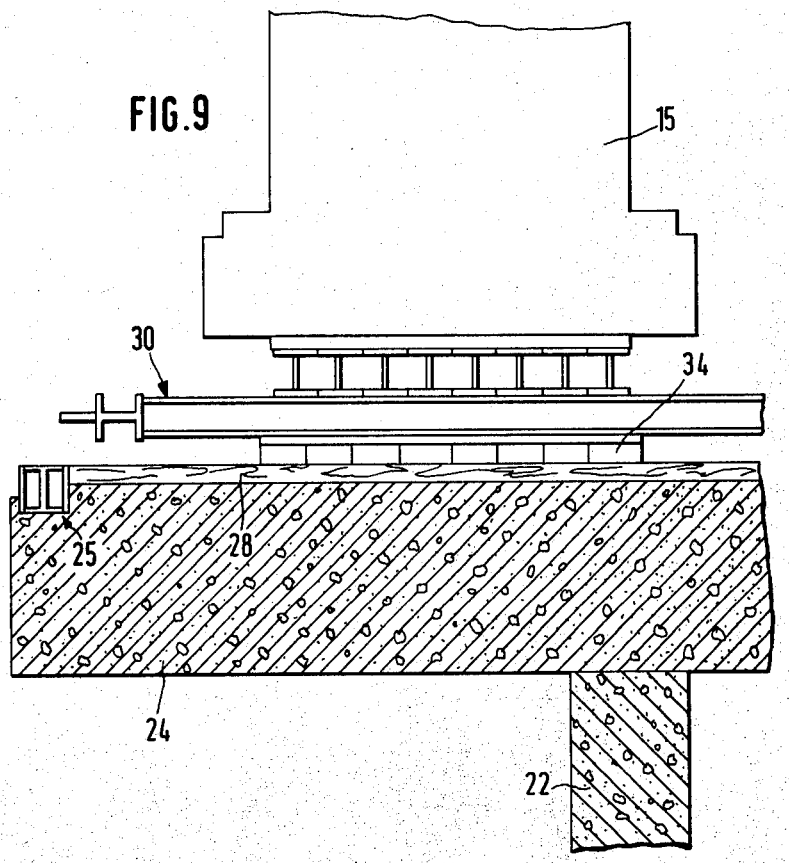
FIG. 9 is a cross-sectional view on an even larger scale of the rotating arrangement shown in FIGS. 7 and 8.

At this point, the rotating arrangement is mounted on the slab 24. The rotating arrangement is shown in detail in FIG. 8. An annular frame 25 consisting of outer frame parts 26 and inner frame parts 27 is braced by means of beams or planks 28. These parts form the lower rotating platform. A pivot 29 is fixed in the center of this platform. With the provision of a lubricant between them, an upper rotating track 30 is placed on the rotating platform 25. Rotating track 30 consists of two curved rails each located on an opposite side of the pivot 29 and disposed in spaced relation. Curved rails 31 are stiffened by means of transverse girders 32 and diagonal girders 33. Pivot 29 has a bore located in the center of the rotating track 30. Located on the rotating track are the bottom supports 35, 36 for the roller trestles 15, 16. Supports 35, 36 are provided with a wooden support 34.

After the rotating arrangement has been assembled, roller trestle 16 is moved from the central position in alignment with the frame 14 slightly laterally above the support 36 and the roller trestle 15 which has not yet been utilized, is moved inwardly over the support 35. The scaffolding girder 3 is then lowered onto the roller trestles 15, 16 and, thus onto the rotating platform. As a result, the scaffolding girder 3 has the necessary spread support required for free rotation. If the center of gravity of the scaffolding girder 3 is not yet positioned above the pivot 29, the scaffolding girder 3 must be moved into the centered position not later than at this stage in the movement of the scaffolding girder. Accordingly, the scaffolding girder 3 can be rotated from the position extending in the longitudinal direction of the multiple spans to a transverse position.

To provide for the rotation of the scaffolding girder 3, cams 37 are arranged in spaced relation on the radially outer surfaces of the curved rails 31. These cams 37 can be engaged by a shoe 38 mounted on the end of piston rod 40 of a cylinder piston unit 41. Two identical cylinder piston units 41 are rigidly arranged diametrically opposite one another on the slab 24. By extending the piston rods 40 in the cylinder piston units 41, the rotating track is turned together with the scaffolding girder 3 supported on the roller trestles 15, 16. FIG. 3 illustrates the position of the scaffolding girder 3 after being turned through approximately 90° so that it extends transversely of the longitudinal direction of the multiple spans.

In FIG. 3 a row of columns of bridge I is shown spaced laterally from a column or pier 1'' forming a part of the row of piers of bridge II. On the section of superstructure 2'' already completed on column 1'' a similar tower 22' is positioned with a slab 24' located on top of the tower. After the right-hand girder section 5 of the scaffolding girder 3 as shown in FIG. 3 is supported temporarily by means of a spacer 42 over the pier 1'', roller trestle 16 is moved along the scaffolding girder into position above the pier 1''. Subsequently, the scaffolding girder 3 can be moved on the roller trestle 15 located above pier 1' and also over the roller trestle 16 until the scaffolding girder 3 is centered above the pier 1'' in the same position as illustrated in FIG. 3 for the pier 1'. After transferring the rotating arrangement to pier 1'', the scaffolding girder 3 can be rotated back into the longitudinal direction of the multiple spans of the bridge II. Next, the scaffolding girder is lowered. In the lowering operation, the support structures are disassembled step by step in the middle region and at the end. After returning the formwork 12 to the working position and retracting the inner platform girders 11, it is possible to use the scaffolding girder 3 for forming the superstructure in the opposite direction until the initial point is reached.

While specific embodiments of the invention have been shown and described in detail to illustrate the application of the inventive principles, it will be understood that the invention may be embodied otherwise without departing from such principles.

What is claimed is:

1. In the construction of a pair of side-by-side bridges including vertically extending support piers and a continuous superstructure supported on the piers where a scaffolding girder and formwork dependently supported therefrom are used for forming the superstructure and where the scaffolding girder is moved on trestles suspended from the scaffolding girder in the longitudinal direction of the superstructure for forming individual sections thereof, the method of transferring the scaffolding girder comprising the steps of supporting the center of gravity of the scaffolding girder on a trestle over a pier of one of the bridges with the scaffolding girder extending hn the longitudinal direction of the one bridge, rotating the scaffolding girder about a vertical axis from the position extending in the longitudinal direction of the one bridge to a position extending transversely of the longitudinal direction of the pair of bridges with one of the trestles located over a pier of the one bridge, moving at least one other trestle to a position supported on a pier of the other bridge, moving the scaffolding girder in the transverse direction into a position with the center of gravity of the scaffolding girder supported over the trestle located over the pier of the other bridge, and rotating the scaffolding girder to a position extending in the longitudinally direction of the other bridge while maintaining the center of gravity of the scaffolding girder over the trestle located over the pier of the other bridge.

2. In the method as set forth in claim 1, the further step of raising the scaffolding girder upwardly from the superstructure of the one bridge until the lower surface of the formwork depending from the scaffolding girder is located above the superstructure, maintaining the scaffolding girder in the raised position until it is rotated into the longitudinal direction of the other bridge and lowering the scaffolding girder and the formwork dependently supported therefrom.

3. In the method as set forth in claim 2, including raising the scaffolding girder at two positions spaced along the scaffolding girder using lifting devices, alternately actuating the lifting devices and inserting support structures under the scaffolding girder.

4. In the method as set forth in claim 3, including locating one of the supports at the trailing end of the scaffolding girder with respect to the direction in which the scaffolding girder is to be moved from one bridge to the other and locating the other support at one end of the center of gravity of the scaffolding girder or at the leading end of the scaffolding girder in the direction of movement from the one bridge to the other.

* * * * *